United States Patent [19]

Umans et al.

[11] 4,269,594

[45] May 26, 1981

[54] CONTACT HEAT FUSING APPARATUS

[75] Inventors: Frans M. Umans, Mortsel; Willy G. Ceuppens, Borgerhout; Willy J. Palmans, Kessel; Robert T. Overmeer, Mortsel, all of Belgium

[73] Assignee: AGFA-GEVAERT N.V., Mortsel, Belgium

[21] Appl. No.: 966,595

[22] Filed: Dec. 5, 1978

[30] Foreign Application Priority Data

Dec. 7, 1977 [GB] United Kingdom ..... 50952/77

[51] Int. Cl.[3] ..... G03G 13/20; H05B 3/10

[52] U.S. Cl. ..... 432/59; 432/60; 271/273; 100/93 R; 219/216; 355/3 FU

[58] Field of Search ..... 432/59, 60, 228, 75; 219/469, 216; 100/93 R; 355/3 FU; 226/186, 187, 190, 194; 271/273, 274

[56] References Cited

U.S. PATENT DOCUMENTS

| | | | |
|---|---|---|---|
| 2,849,230 | 8/1958 | Danly et al. | 226/186 |
| 2,995,363 | 8/1961 | Pittwood | 271/273 |
| 3,069,058 | 12/1962 | Haff, Jr. | 226/187 |
| 3,289,907 | 12/1966 | Horberg | 226/194 |
| 3,291,466 | 12/1966 | Aser et al. | 432/228 |
| 3,299,801 | 1/1967 | Bishop | 226/194 |
| 3,300,114 | 1/1967 | Jacobsen | 226/194 |
| 3,428,308 | 2/1969 | Bernard | 271/273 |
| 3,514,099 | 5/1970 | Miller et al. | 271/273 |
| 3,561,658 | 2/1971 | McDermott | 226/186 |
| 3,811,821 | 5/1974 | Ariyama et al. | 432/60 |
| 3,846,808 | 11/1974 | Whall | 226/190 |
| 3,861,863 | 1/1975 | Kudsi | 432/60 |
| 3,881,859 | 5/1975 | Hamilton | 432/60 |
| 4,001,545 | 1/1977 | Wada et al. | 432/60 |
| 4,007,865 | 2/1977 | Crandall | 226/187 |
| 4,038,026 | 7/1977 | Wada et al. | 432/60 |
| 4,087,676 | 5/1978 | Fukase | 432/60 |
| 4,147,501 | 4/1979 | Goshima et al. | 432/60 |

*Primary Examiner*—Henry C. Yuen
*Attorney, Agent, or Firm*—William J. Daniel

[57] ABSTRACT

A unit for heat fixing xerographic images makes use of a fuser roller and a self adjusting pressure roller. The fuser roller is internally heated and it may be associated with a self adjusting cleaning roller. The preceeding elements may be combined into a unit which can be provided moreover with scraper elements and supplementary feeding rollers located downstream of the fuser and fusing rollers and which rotate at a peripheral speed exceeding that of the latter rollers.

11 Claims, 11 Drawing Figures

CONTACT HEAT FUSING APPARATUS

The invention is concerned with a contact fusing apparatus for heat-fusing xerographic toner images on image supports.

Fixing units in modern xerographic copying machines often employ a so-called fuser roller and an opposed so-called pressure roller, which together form a bite or nip through which a sheet or web support, bearing a toner image to be fixed, is conveyed. The fuser roller is heated to cause fusion of the toner on its support.

It is normal to provide the fuser roller with a surface layer or coating of a heat resistant, elastically deformable material which tends to repel toner particles and therefore reduces the tendency of toner particles to adhere to the fuser roller and to form spurious toner deposits on support areas which should remain clear. Usually a silicon elastomer is used for this toner repelling heat resistant layer or coating.

Examination of xerographic copies from machines having such fixing units shows that the toner deposits are often not properly fixed over the whole toner image area. This has been thought to be due to uneven distribution of pressure along the bite between the fuser and pressure rollers. The uneven distribution of pressure along the bite between fuser and pressure rollers may also lead to the phenomenon that the support bearing the toner image may become wrinkled. Moreover, as a further consequence may be mentioned the uneven distribution of the shear stresses in the toner repelling coating provided on said rollers which may result in local formation of microscopic cracks in such coatings.

It is an object of the present invention to provide a contact fusing apparatus constructed to avoid or reduce the disadvantages above referred to and associated with the known units.

According to the present invention, there is provided a contact fusing apparatus for fusing a toner image on a support, comprising a fuser roller carrying an elastically deformable surface and having associated heating means for heating such roller to cause fusion of toner, an opposed pressure roller forming with said fuser roller a bite through which a support carrying a toner image can pass, means to which driving torque can be transmitted for driving at least one of such rollers, and clamping means operative to exert force on at least one of such rollers to cause them to exert in the bite a clamping pressure sufficient to cause elastic deformation of the elastic fuser roller surface, the apparatus incorporating roller mounting means which while said clamping force is exerted permits relative divergence of the axes of the fuser and pressure rollers to occur to an extent which is non-uniform along the length of the rollers.

Experiments show that the mounting of one or both of the fuser and pressure rollers so that the spacing between the roller axes can vary non-uniformly along their length under separating forces as referred to, makes the apparatus better able to produce well fixed images even after considerable use.

Examination of imperfectly fixed toner images fixed by fuser roller apparatus as previously constructed reveals that in many cases the images comprise areas of different density and it is in the areas of relatively low image density that the toner has not been properly fixed. Quite often the density of a toner image varies in the widthwise direction of the support, at one or more regions along its length. Where a relatively low density image area exists alongside a relatively high density image area the tendency for the relatively low density toner deposit to be inadequately fixed is particularly evident. High and low density areas may be produced by any known method in xerography e.g. by image-wise exposure and subsequent developement of a uniformly charged xerographic belt or drum having its back side at an elecrtric DC-potential opposite to that of the charging corotron during the charging exposure and development step by means of e.g. a magnetic brush which is electrically grounded for the purpose of reducing background fog.

It has been found that an apparatus according to the invention is better able to fix high and lower density toner deposits areas of the image support which are side by side. However that is not the only advantage. The specified roller mounting principle makes it easier to establish a satisfactorily uniform bite pressure initially, when the apparatus is assembled, and easier to maintain that condition over periods of use.

In apparatus according to the invention, the fuser roller or the pressure roller or both of them may be moveable into operative position from an inoperative out of contact position. Roller displacements between operative and inoperative positions can e.g. be brought about under automatic control, as known per se, in timed relation to the passage of image-bearing supports between the rollers. In that way direct contact between the very hot fuser roller and the pressure roller can be confined to a very short period of time in each cycle of the machine. If at the moment the two rollers come into contact as their working relationship is being established, they do not make contact along the whole length of the rollers but only at one end portion of that length, this misalignment will tend to be automatically corrected as the clamping pressure is exerted. This is due to the roller mounting means having the characteristic hereinbefore specfied. That mounting means is therefore not only useful in enabling the bite profile, formed by the rollers, to vary responsive to non-uniform separating forces exerted by material passing through the bite, but is also of value in promoting self-alignment of the rollers upon movement into their operative cooperating relationship.

In preferred embodiments of the invention, the fuser roller or the pressure roller or each of them has a mounting means which permits that roller to cant bodily, with its axis remaining in a plane parallel with the axis of the other roller. In a preferred construction, at least one of the rollers is rotatably mounted in a yoke which is mounted on a carrying arm so that the yoke can cant about a central axis normal to the axis of that roller.

The preferred type of roller mounting, as already mentioned, is one wherein the roller can cant bodily. Preferably the mounting means permits the axis of the fuser or pressure roller as the case may be cant through an angle of at least 20° in either direction from neutral when contacting the opposed roller. The extent to which the roller can cant while the roller clamping pressure is exerted will, in the absence of other restraint, depend on the elastic yield capacity and resistance of the surface of the fuser roller and on the elastic yield capacity (if any) and elastic yield resistance of the pressure roller surface under the load conditions.

The clamping means preferably creates a clamping pressure of from 2.5 to 7.5 kp/running cm between the rollers.

The fuser roller preferably has internal heating means. For example it may be heated by means of a built-in infrared light source or by means of wire resistances. A particularly suitable heating means comprises an infrared radiator located inside the fuser roller. A simple roller temperature control is then possible. By means of a tempature-sensing device, e.g. a thermocouple, the temperature of the fuser roller surface can be measured and variations in the signal generated by the thermocouple can be used for regulating the power delivered to the infrared radiator.

As an alternative, the fuser roller can be heated by means of an external heat source, but that requires more space and entails larger heat losses.

The heating means for the fuser roller preferably serves to bring the surface of the fuser roller to a temperature between 164° and 225° C.

The pressure roller may e.g. comprise a solid stainless steel cylinder with a heat insulating surface layer, e.g., a layer composed of a polymeric fluorocompound such as polyfluoroethylene such as is commercially available under the track mark "Teflon". A suitable heat insulating surface layer may be provided by heat shrinking a hose of the heat insulating material onto the cylinder. This technique is less time consuming and permits finer surface finishes to be obtained that by applying and then curing layers of a coating composition.

Advantageously the apparatus incorporates at least one cleaning roller which is in rotatable contact v/ith, e.g. is freely rotatably by, the fuser roller and has surface adsorption characteristics such that it takes up tackified toner particles from the contacting fuser roller. Preferably this clea..ing roller is self-aligning with the contacting fuser roller. Such a self-aligning property can be achieved by mounting the cleaning roller in the same manner as hereinbefore described in relation to the fuser and pressure rollers, so that it can cant in responsive to any imbalance in the pressure exerted on it by the contacting fuser roller.

If desired the pressure roller may also have a cleaning roller associated with it.

it is recommended to provide downstream from the bite formed by the fuser and pressure rollers, a pair of scrapers or deflectors which in the event of the image support clinging to the fuser roller or the pressure roller upon emergence from the bite, intercepts the leading edge of the support and deflects it into the correct path.

There is preferably a pair of transport rollers located downstream from the fuser and pressure rollers for transporting image-bearing supports out of the apparatus. Preferably the transport rollers are associated with driving means for rotating them at a peripheral speed exceeding that of the fuser and pressure rollers, e.g., by about 10%. An image-carrying support whose leading end portion passes between such transport rollers while the trailing end portion of the support remains between the fuser and pressure rollers becomes slightly tensioned and is thereby kept flat to faciliate its further handling.

Apparatus according to the invention can be constructed as an integral unit which can be inserted and withdrawn bodily into and from a xerographic copying machine. The unit may have drive input gearing adapted to couple or be coupled with the master motor of the copying machine either directly or indirectly through other driven parts of the machine so as to achieve correct synchronization of the operation of the fixing unit with the other functions of the copying machine.

An embodiment of the invention, selected by way of example, will now be described with reference to the accompanying diagrammatic drawing, in which.

Figure 5:
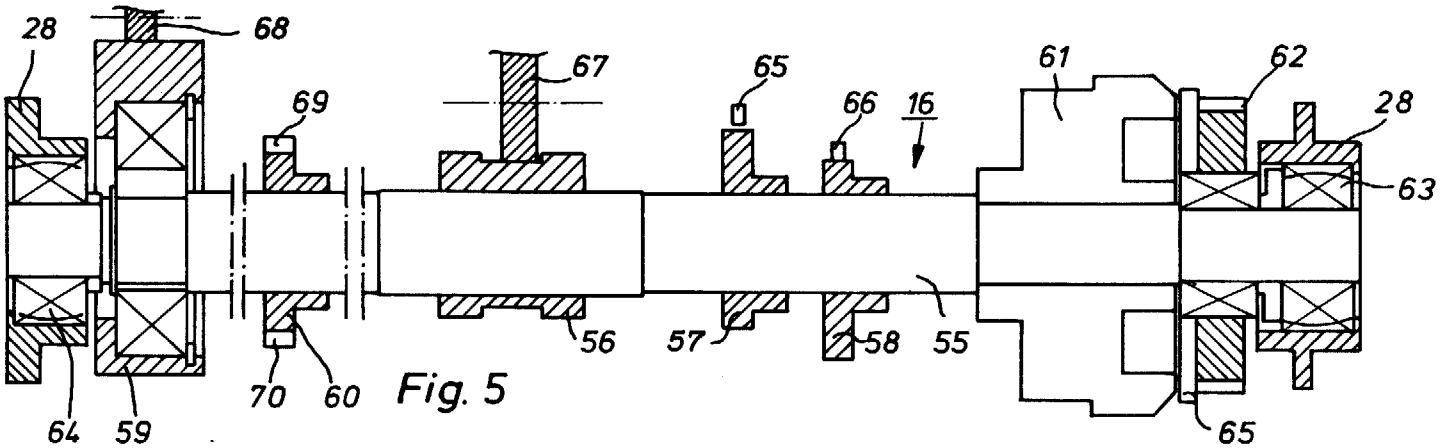
Figure 9:
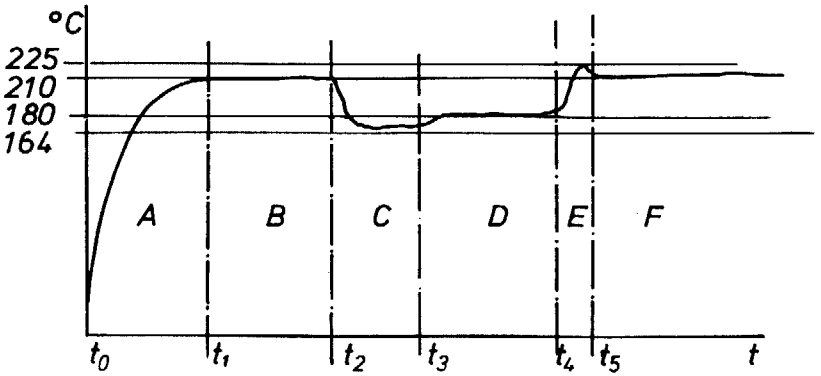
Figure 10:
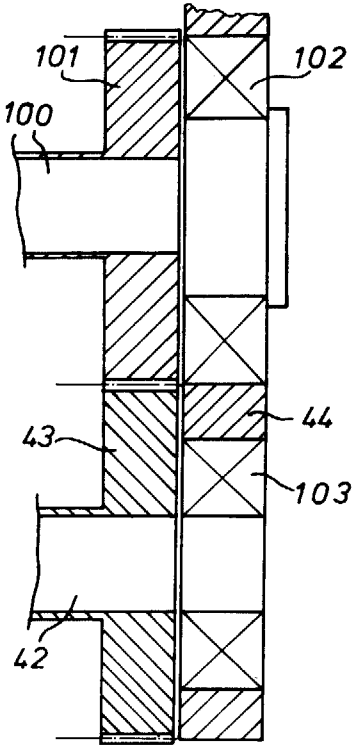
Figure 6:
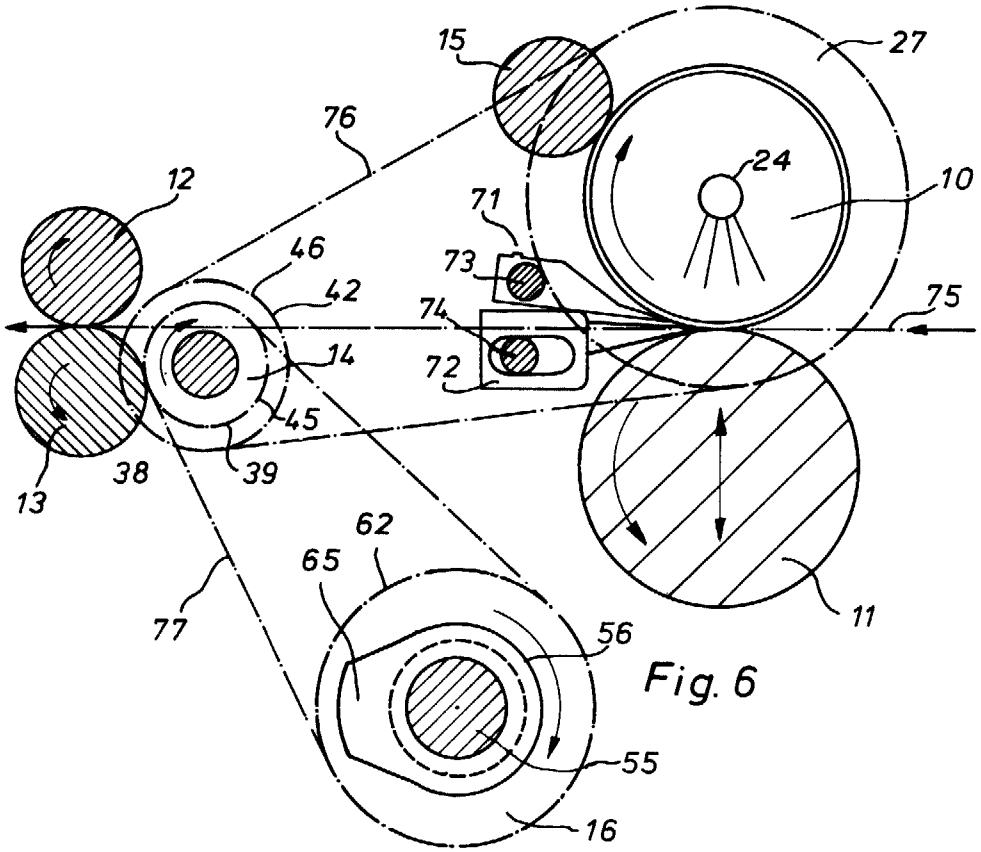
Figures 7, 8:
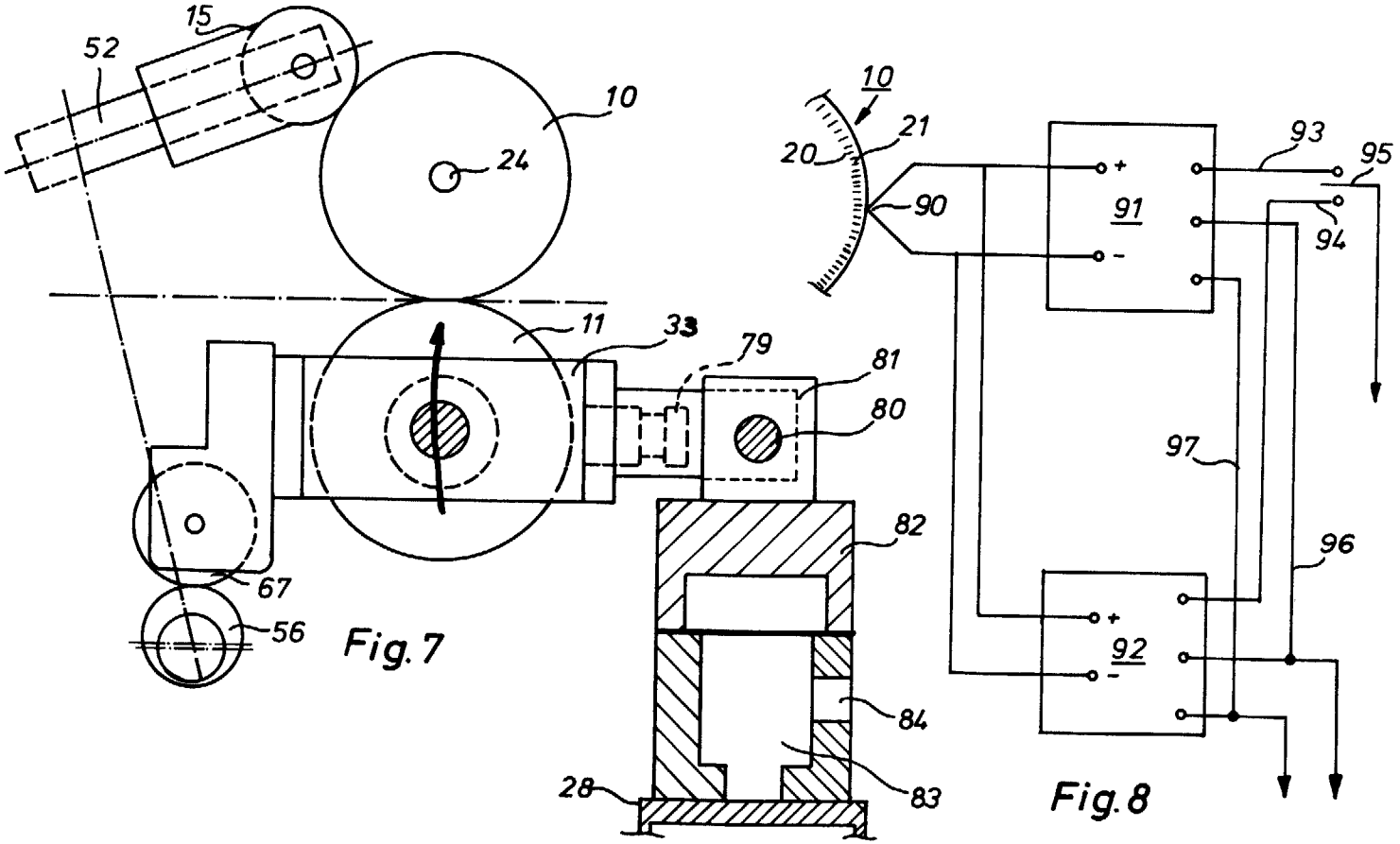
Figure 11:
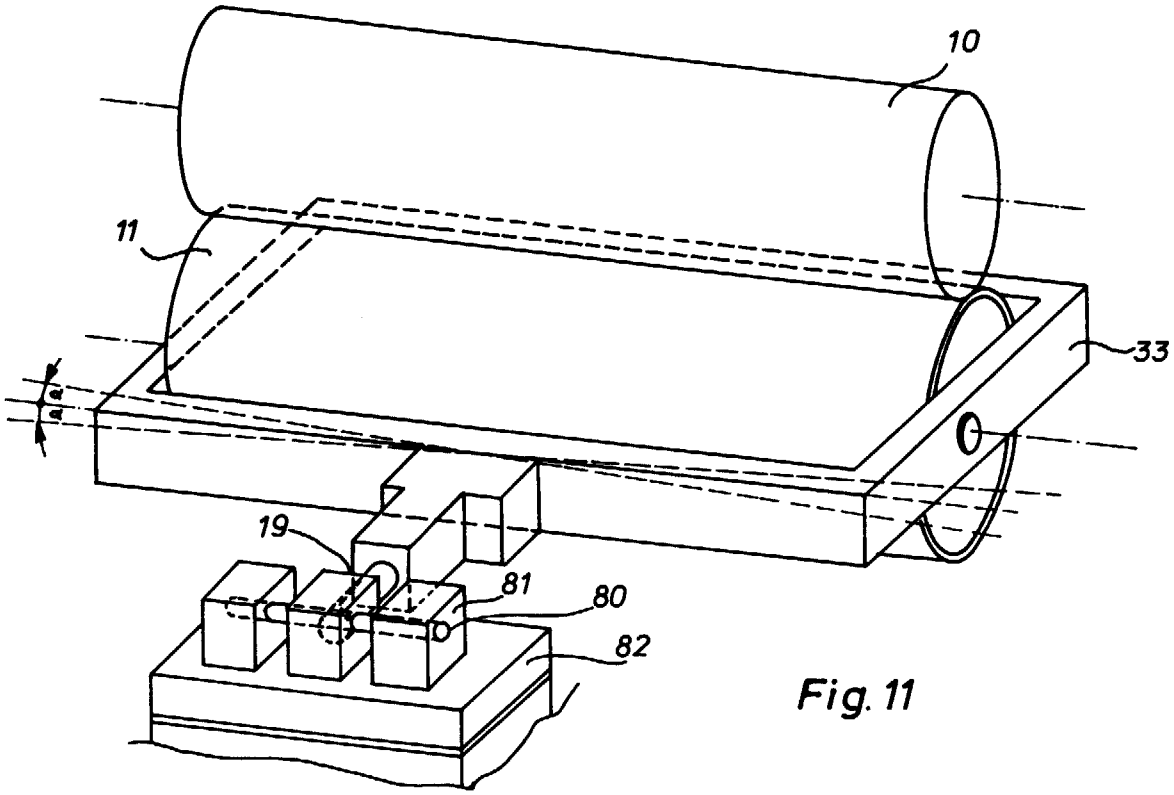

FIG. 5 shows the mechanism for bringing the pressure roller in contact with the fuser roller, FIG. 6 is a side view of the drive system, FIG. 7 is a side view, showing the mounting of the pressure roller, FIG. 8 shows the circuit for controlling the temperature of the surface of the fuser roller, FIG. 9 shows the temperature/time relationship of the surface of the fuser roller, FIG. 10 shows the engagement of a drive roller in a copying machine with the drive roller of the heat fixing apparatus according to the invention, and FIG. 11 is a right side elevation in perspective of the pressure roller and mounting of FIG. 7.

A typical general arrangement for the apparatus of the invention appears in FIG. 6 and includes a fixing zone constituted by the fuser roller 10 and opposed pressure roller 11, with their associated accessory elements, e.g. a cleaning roller 15 and sheet deflectors 71, 72, into which a support carrying a toner particle image to be fixed is introduced; a sheet transport zone downstream of said fixing zone and constituted by transport roller pair 12, 13 and drive roller 14 drivingly coupled thereto and to at least one roller of the roller in the fusing zone; and a control system 16 formed by shaft 55 and associated control cams carried thereon, the control system being drivingly connected to drive roller 14 for synchronous rotation therewith and thus with the other rollers of the system and functioning during a given operational cycle to activate various control elements, not shown, for performing the needed operational functions at proper intervals during the cycle. The details of the components of these various components of these zones and system will now be described individually.

Figure 1:
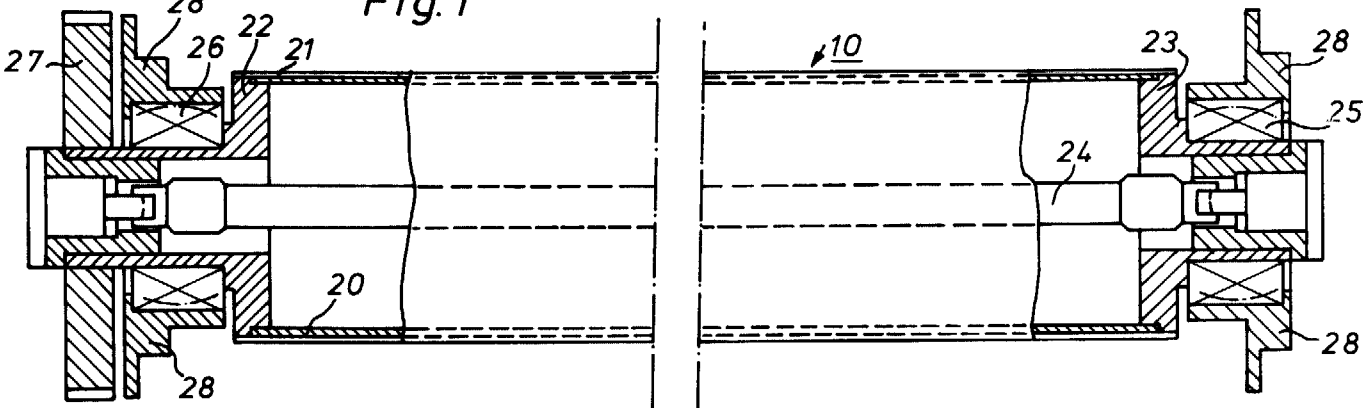
FIG. 1 is a partly sectional view of the fuser roller.

As may be seen in FIG. 1, a fuser roller 10, forming part of a contact heat fixing system, comprises a metallic cylinder 20, onto which a layer or coating of a heat resistant, deformable and preferably toner repellent material 21 is provided. Suitable flanges 22 and 23 serve as supports for the tube 20. At the inside of the roller 10, an infrared light source 24 is provided which may be connected to a source of electric current (not shown) in order to emit radiant energy in the form of heat for the purpose of bringing the layer 21 to a temperature suitable for at least tackifying the toner image on a support (both not shown).

The infrared light source 24 is resiliently mounted at one side. It does not undergo, however, any rotation around its longitudinal axis when the fuser roll 10 starts to rotate under the influence of the rotating imparted to a chain and sprocket 27 affixed to the end of roll 10. In order to guarantee a smooth rotation, bearings 25 and 26 are provided at the outer extremity of the flanges 22 and 23, which bearings are journalled in the frame 28 of the copying machine.

In a practical embodiment, the infrared light source 24 can be a halogen flood light type lamp of about 25 cm marketed by Philips' Gloeilampenfabrieken N.V., and having a filament configuration enabling a uniform temperature distribution. It will be clear that the working point of the infrared light source will be such that this nominal power is but economically used so that a favourable effect upon the lifetime of the light source is obtained. The temperature range within which the surface of the fuser roller is to be brought for adequate fixing at the speed concerned lies between 158° and 170° C.

The temperature controlling system of the infrared light source 24 will be explained in the further source of the description.

Figure 2:
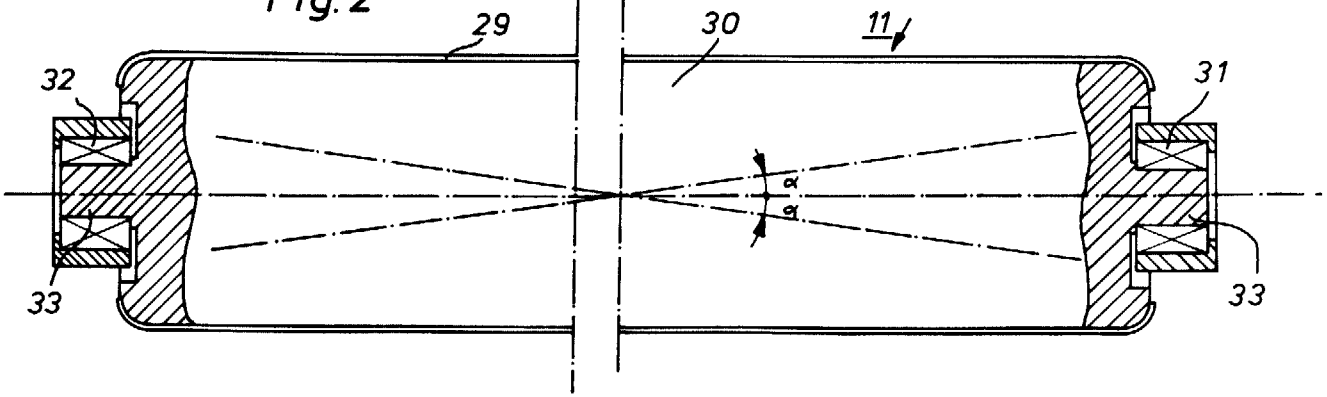
FIG. 2 is a partly sectional view of the pressure roller.

In distinction with the fuser roller 10, the pressure roller 11 has a solid structure, as may be seen from FIG. 2. At the periphery of the pressure roller 11 a sleeve 29, made of polytetrafluoroethylene, has been applied by heat shrinking. The heat shrinking process was carried out at 200° C. for 45 minutes with a tubelike material with a diameter exceeding by 5 to 30% the diameter of the core 30.

The extremities of the core 30 are located in bearings 31 and 32, which are mounted in a frame 33 (here shown in longitudinal section).

The frame 33 is mounted for limited pivotal movement, in such a way that the longitudinal axis of the pressure roller 11 may become inclined with respect to the horizontal over a small angle $\alpha$. As the pressure roller 11 is intended to be driven by the contact with the fuser roller 10 upon rotation of the latter, no supplementary driving elements are required. In preferred embodiments, the core 30 of the pressure roller 11 is made of stainless steel.

Figures 3, 4:
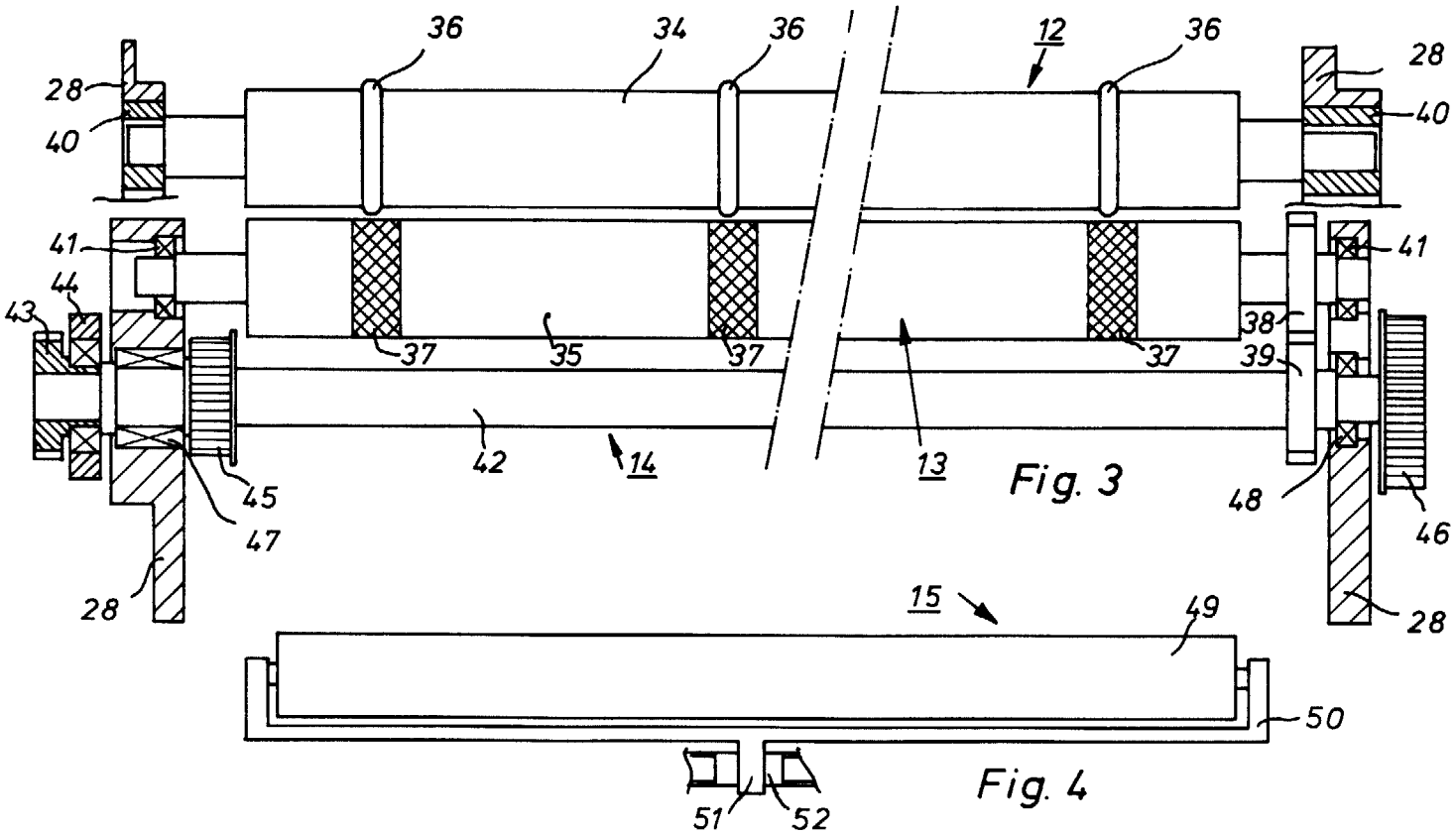
FIG. 3 is a view of the transport rollers and the drive roller.
FIG. 4 is a view of the cleaning roller.

In FIG. 3 are illustrated the transport rollers 12 and 13 and the system's drive roller 14.

The transport rollers 12, 13 are composed of solid cylinders 34 resp. 35 which are provided with friction enhancing means on their cooperating surfaces.

So on roller cylinder 34, there are provided a plurality of rings 36, made of rubber or an other material having a high coefficient of friction, whereas on roller cylinder 35, a corresponding plurality of knurled areas 37 extending on the periphery of roller cylinder 35 are provided. In this way a plurality of zones (36, 37) are formed which enable a faultless or slip-free transport of the support (not shown) passing between the rollers 12, 13. Rotation can be imparted to roller 13 with the help of gear wheel 38 located at the extremity of its shaft, mating with gear wheel 39 on drive roller 14. The provision of zones of increased friction between the rollers 12 and 13 makes roller 12 freely rotate by the contact of its ring 36 with the knurled areas 37 on roller 13. Transport roller 13 is journalled at its shaft extremities in bearings 41, whereas transport roller 12 is mounted for free rotation and is provided at its shaft extremities with oversize bushings 40 permitting a slight vertical displacement of this roller.

The drive roller 14 is intended for linking the entire fixing unit with the master drive (not shown) of the copying apparatus. It is composed of a rigid cylinder 42 made of stainless steel. At one extremity of cylinder 42, gear wheel 43 is provided which may be coupled with another gear wheel either directly or indirectly driven by the master motor (not shown) of the copying apparatus. At the same drive roller extremity is also provided ring 44 the peripheral surface of which is ground and the function of which will be explained in the further disclosure.

There are also provided on roller 14 two sprockets 45, 46 over which belts may be passed, for transferring the rotation of drive roller 14 to the other rotational rollers of the contact fusing unit.

As with all other rollers, the drive roller 14 is also mounted in suitable bearings 47, 48 journalled in the frame 28 of the copying apparatus.

In FIG. 4 a top view of a cleaning roller 15 is given, which roller comprises a solid cylindrical body 49 which may be made of a material having better adsorption characteristics with respect to the tackified toner image than does the surface material of the fuser roller 10 and the pressure roller 11. The material which is used may be aluminum, or a material which is sold under the trade mark "Ferrozell" by Ges. Sachs & Co., Augsburg, F.R.G.

The cleaning roller 15 is mounted in a self-adjustable fashion similar to the arrangement of the pressure roller 11. In this way a more evenly distributed pressure may be obtained at its contact plane with the fuser roller 10. The self-adjusting effect is obtained by mounting the extremities in the arms of a brace or yoke-shaped member 50 which is capable of a limited pivotal movement around a spindle 51 mounted in a roller bearing 52. In a preferred embodiment, the course of, and the pressure exerted by, cleaning roller 15 may be adjusted. A normal value for this pressure amounts to about 300 g/running cm.

The toner particles which would otherwise adhere to the surface of the fuser roller 10 will now become collected at the surface of the cleaning roller 15, which after a great number of supports have been fixed acquire a coloured surface due to toner deposition. This deposit may be removed from the surface by washing the roller with adequate toner solvents or simply by scraping the solidified toner from the roll by means of a scraper or knife.

FIG. 5 shows the control system 16 which controls amongst others the lifting up of the pressure roller 11 during the heat fixing or heat fusing cycle.

The control system 16 comprises a solid shaft 55, onto which a plurality of cams 56, 57, 58 and 59, a positioning wheel 60, a half-revolution electromagnetic clutch 61 and a pulley 62 are provided. The extremities of the shaft 55 are located in bearings 63 and 64, mounted in the frame 28 of the copying apparatus.

The sprocket 62 is journalled on a shaft for free rotation, together with a circular disk 65 and both continuously rotate at a speed which is in synchronism with that of the drive roller 14, through the intermediary of sprocket 46 (see FIG. 3 again). By means of a signal, indicating that a support is about to be processed, which signal may be generated by suitable detection means (not shown), located upstream of the heat fixing unit, an electromagnetic clutch 61 becomes energized and is carried along with disk 65 so that the shaft 55 and the cams 56, 57, 58 and 59 and the positioning wheel 60 rotate. Contacting cams 57 and 58 are mounted the extremities 65, 66 resp. of the arm of a moving contact of a microswitch (not shown) as cam followers. The peripheries of cams 57 and 58 are angularly spaced over 180 degrees and the eccentricity amounts to such an extent that when one contact is closed, the other is opened and vice versa. In the position as illustrated in FIG. 5, the microswitch associated with cam follower 65 will be closed, so that the high parts of cams 56 and 59 will point in upward direction, their respective cam followers 67 and 68 being in upward condition.

Cam follower 67 is linked with the frame 33 in which pressure roller 11 (see FIG. 2) is journalled, so that in the position illustrated, the pressure roller 11 is in contact with the fuser roller 10.

Cam 59 has a cam follower 68 which controls the positioning of the cleaning roller. It will be clear that contact with the fuser roller 10 must occur simultaneously for the pressure roller 11 and for the cleaning roller 15 as well.

Positioning wheel 60 is in the form of a circular disk having two diametrically opposed recesses 69 and 70, in which a yieldable stopping member or detent (not shown) may be engaged when the cams point upwardly and downwardly, in order to provide for a kind of stabilization when the heat fusing unit is in its operative resp. inoperative position.

After the fusing cycle has come to an end, which event may be detected by suitable detector means, the electromagnetic clutch 61 is again temporarily energized so that another rotation over 180 degrees occurs and the cams 56 and 59 again point in downward direction. At that moment the pressure roller 11 and the cleaning roller 15 assume their inoperative condition.

By the fact that cams 56, 57 and 58 may be angularly displaced, the ultimate end position of the pressure roller 11 in its path towards the fuser roller and the dead point at which the microswitches associated with cam followers 65 and 66 are energized or de-energized may be regulated, so that small pressure fluctuations due to the diameter toleracnes of the pressure roller 11 may be compensated.

FIG. 6 gives the spatial configuration of the transport system of the complete heat fusing apparatus.

Once the arrival of an image bearing support in the course of being processed is signalled by a further signalling device different from the foregoing and not shown, the drive roller 14 starts rotating in synchronism with the other transport means (not shown) umstream in the copying apparatus.

As a consequence thereof, the fuser roller 10 and the pulley 62 of the control system 16 start to rotate. Fuser roller 10 is driven by belt 76 tensioned over pulley 27 located at one of its extremities and over pulley 46 on shaft 42 of drive roller 14. An analogous mechanism imparts a rotation to pulleys 62 and 45 carrying a belt 77. The transport roller pair 12 and 13 is set in motion by the action of gear wheels 38 and 39.

Once an image bearing support is in close proximity of the fusing station, pressure roller 11 is lifted in upward direction and is pressed against fuser roller 10, so that the image bearing support, following the path, indicated by numeral 75, is fed into the nip between the fuser roller 10 and the pressure roller 11.

In the meantime the cleaning roller 15 is also urged against fuser roller 10, at a point located at about 120 degrees downstream of the nip between fuser roller 10 and pressure roller 11.

A pair of scrapers 71 and 72 supported on rods 73 resp. 74 are placed immediately after the nip between fuser roller 10 and pressure roller 11 in order to intercept the leading edge of the image bearing support and thus the risk that the latter would keep sticking to the surface of either the fuse roller 10 or the pressure roller 11. Preferably the distance at which the edges of scrapers 71, 72 are located from the rollers 10 and 11 amounts to about the thickness of the image bearing support.

Once the leading edge of the image bearing support reached the nip of transport roller pair 12 and 13, it is tensioned due to the fact that the peripheral speed of the transport roller pair slightly exceeds (by about 10%) that of the pair formed by the fuser roller 10 and the pressure roller 11. As a consequence of this stretching, the risk of buckling of the image bearing support is completely avoided. Then via the transport rollers 12 and 13, the image bearing support is moved out of the apparatus.

Thereupon the magnetic clutch 61 (see FIG. 5) is again energized, so that the shaft 55 of the control system 16 performs another rotation over 180 degrees, so that the cams located thereon bring the electric and mechanic parts into de-energized condition.

The rotation of the rollers involved is now stopped and the pressure roller 11 as well as the cleaning roller 15 no longer remain in contact with the fuser roller 10.

FIG. 7 illustrates the mechanism for bringing the pressure roller 11 into and out of contact with the fuser roller 10. As already mentioned hereinbefore, the pressure roller 11 is mounted in a generally yoke-like frame 33. As seen more clearly in FIG. 11, one of the sides of yoke-like frame 33 is pivotally mounted on a pin 80 located in housing 81. The frame 33 also simultaneously pivots around a pin 79. As a result of such configuration the pressure roller may be moved bodily in an upward or downward direction by pivoting around pin 80 as indicated by the arrow. In accordance with the invention, the axis of pressure roller 11 may carry out small canting movements about pin 79 in a given vertical plane so that its position may vary slightly from parallelism with respect to the axis of fuser roller 10 for the purpose of more uniformly distributing the pressure exerted on the fuser roller 10.

The rotation of pressure roller 11 and its associated frame 33 is governed by the eccentric cam 56 forming part of the control mechanism which brings cam follower 67 in upward or downward direction. When displaced to upward condition, the pressure roller 11 exerts a uniform pressure upon the peripheral surface of the fuser roller 10 and partly compresses the layer of silicone rubber 21 provided thereon.

The pressure exerted by the pressure roller 11 may be measured and controlled by providing a housing 82, the interior of which conforms to the contours of a pressure sensitive measuring cell 83 delivering an electrical analog signal proportional to the pressure applied thereto. The output signal of the cell 83 may be fed via access opening 84 in the housing to one or other monitoring instrument (not shown) so that possible fluctuations of the pressure are signalled and may be compensated, if necessary.

FIG. 8 illustrates how the temperature of the fuser roller 10, may be controlled. Therefore a thermocouple 90, e.g. of the iron constant class, is connected to the input terminal of two parallelly coupled regulators 91 and 92 which both have two of their three output terminals parallelly connected. Regulator 91 provides for a temperature control of the infrared light source 24 (see FIG. 1) located in fuser roller 10 during the periods of standby when no contact between the fuser roller 10 and the pressure roller 11 is established and no support to be fixed is signalled. Regulator 92, on the contrary, is put into service when a fixing cycle has to be carried out. Switching from one regulator to the other occurs with the help of switch 95 the position of which may be changed as a function of the presence of an image-carrying support or not, which condition as mentioned is signalled by one or more detecting devices. Switch 95 connects output terminal 93 to the gate electrode of a semiconductor of the triac type during the standby period, whereas in the operative position output terminal 94 is connected to said gate electrode. Output terminals of the regulators are coupled in parallel by lines 96 and 97 and are connected with the anode of the triac, resp. with the electrical source to which the infrared light source is connected. The cathode of the triac and the other terminal of the light power source are interconnected with each other. The regulators 91 and 92 are respectively set at the standby and the working temperature of the fuser roller 10. It will be clear that instead of a thermocouple, also other measuring devices having temperature dependent characteristics, such as NTC-resistors may be used if desired. The energy delivered to the infrared light source occurs in the form of pulse width modulated 220 V/50 Hz trains which become narrower when the set temperature is approached. Also alternative regulators such as thyristor regulators may be used with advantage.

FIG. 9 illustrates how the temperature at the surface of the fuser roller 10 may vary as a function of time. In a typical example, the linear speed of the image bearing support moving through the fixing unit was set at 163 mm/s. In the graph of FIG. 9 the temperature levels have the following significance: defining the lower boundary or limit where "offset" starts at the specific speed 210° C.: the temperature at the surface of the fuser roller during standby condition 180° C.: the temperature at the surface of the fuser roller during the fixing cycle 164° C.: the boundary region where fixing of the toner occurs. When the surface of the fuser roller is lower than 164° C., no fixing occurs at the speed considered.

It will be clear to the skilled worker that even at the speed of 163 mm/s, small fluctuations in the temperatures often occur, due to process parameters, variations in toner deposition, number of copies to be run, relative humidity of the toner image bearing support, the nature of the latter, etc. The period A in the graph of FIG. 9 corresponds with the warmup time of the surface of the fuser roller. In order to remain below the "offset" boundary the temperature at the surface is kept at 210° C. The time lapse $t_0-t_1$ is of the order of 1 to 2 minutes. During the period B ($t_1-t_2$) the standby temperature at the surface of the fuser roller is attained. Apart from small fluctuations, which are imediately compensated by the temperature control system described hereinbefore, the temperature stabilizes and follows a straight horizontal curve. The time period $t_2-t_3$, referred to as C, corresponds with the moment prior to the heat fusing cycle. At that moment, when the cold pressure roller is brought into contact with the surface of the fuser roller, the temperature of the latter suddenly decreases, although sufficient reserve heat is kept available in order to present a drop below the boundary temperature of 164° C., so that the quality of the heat fusing cycle is not impaired. At the moment of fixing, denoted by the period D, the temperature of the surface of the fuser roller rises to 180° C. so that the image bearing support, now present between the fuser roller and the pressure roller is fixed under optimum conditions.

After the fusing cycle, a small period $t_4-t_5$, denoted E, is observed at which the temperature of the fuser roller increases. This is due to the liberation of latent heat still contained in the mass of the fuser roller which cannot be drained, as the pressure roller is no longer in contact with the latter. When no other copying cycle starts again during the period E, the surface temperature of the fuser roller shows a small overshooting versus the 210° C. line.

Finally, the period starting from $t_5$ marks a new period, corresponding with period B in which the fuser roller is again at standby temperature.

In FIG. 10, it is shown how the heat fusing unit—as shown as a whole in FIG. 6—is coupled with the drive mechanism of the copying apparatus or at least with a shaft or gear working in synchronism with the drive mechanism thereof. As already described in FIG. 3, the drive roller 14 is provided at one extremity with a gear wheel 43 and a ring 44, the surface of which is ground smoothly round.

Part of the drive mechanism of the copying machine is illustrated in the form of a shaft 100 bearing a gear wheel 101 intermeshing with gear wheel 43 on the shaft 42 of the drive roller of FIG. 3. In this way the rotation of the gear wheel 101 may be imparted to the gear 43 and through shaft 32 to the fuser unit. In order, however, to guarantee that the intermeshing of the gear wheels 101 and 43 is optimum, roller bearing 102 on shaft 100 and the ground round ring 44, carried by bearing 103 on shaft 42 are provided. Bearing 102 and ring 44 are so dimensioned, that when they are in contact with each other, the gear wheels 43 and 101 are optimally adjusted. By the fact that bearing 102 and ring 44 are free-turning, their point of contact must not necessarily coincide with the point of contact of the pitch circles of the gear wheels 101 and 43.

The provision of these supplementary adjusting means may be necessary when gear wheels having a rather small module (1 mm or even less) or working depth form part of the transport mechanism of the copying apparatus. Moreover, the presence of a supplementary adjusting mechanism provides for an exact and reproducible positioning of the heat fixing unit in the housing of the copying apparatus. If required, signalling means, such as a small lamp, may be provided which indicates such correct positioning.

In a preferred embodiment, the fuser roller consists of a tube in stainless steel or brass having an inner diameter of 41 mm, a thickness of 1.2 mm and a length of 230 mm, onto which a layer of silicone rubber with a thickness of 0.5 mm is provided. Within the tube, and centrally located, is provided a 1000 Watt halogen flood light lamp made by Philips' Gloeilampenfabrieken N. V. This type of lamp enables the fuser roller to attain a surface temperature of 210° C. in standby position.

The pressure roller is made of a solid cylinder in stainless steel onto which a sleeve of poly-tetrafluoroethylene is applied by heat shrinking.

The diameter of the roller is 44 mm and the diameter of the polymeric sleeve before the heat shrinking step is chosen between 4.5 and 30% larger. The heat shrinking step itself consisted in bringing the cylinder over which the sleeve was slipped in an oven at 200° C. during 45 min.

The pressure roller and the heat fuser rollers are mounted in contact with each other and the pressure at the area of contact is adjusted at 3.5 kp/running cm when at operating temperature and with a sheet of paper present between the rollers. The rotational speed of the rollers was set at 163 mm/s. Depending on the speed selected, however, the standby and the working temperature must be varied accordingly. For practical ranges of speed, the temperature at the surface of the heat fuser roller can be varied between 164° C. and 225° C. during periods both of operation and of standby.

As to the pressure between the heat fuser roller and the pressure roller, this may be varied between 2.5. and 7.5 kp/running cm.

Also the thickness of the silicone rubber layer on the fuser roller is dependent on the above phenomenon and said thickness may be varied between 0.2 and 1 mm.

In order to increase the ergonomic properties of the fuser unit and of the copying apparatus in which it is mounted, a sheet detecting circuit may be provided downstream of the nip of the fuser/pressure roller set or of the transport roller pair. The sheet detecting device may be any of the known optical-electronic devices, such as a photocell or photoresistor and an associated lamp, the beam of which incident on the photocell being interrupted by the fixed sheet passing between the lamp and the photocell.

In this way the number of sheets may not only be counted, but also a positive indication about the good functioning of the machine is given since any sheet adhering to any roller is immediately detected.

We claim:

1. A contact fusing apparatus for fusing a toner image carried on a support, comprising a fuser roller having an elastically deformable surface and having associated heating means for heating such roller to a temperature sufficient to cause fusion of toner, an opposed pressure roller forming with said fuser roller a bite through which a support carrying a toner image can pass, means for transmitting a driving torque to at least one of such rollers, clamping means operative to apply a clamping force to at least one of such rollers to maintain the two rollers in an operative position with a clamping pressure in the bite thereof sufficient to cause elastic deformation of said roller surface, separate frame means each having two opposite sides for supporting the opposite ends of said fuser and pressure rollers respectively and means mounting one of said frame means for differential relative limited free bodily movement of its opposite sides, and of the roller ends supported thereby, away from and towards the corresponding sides of the other frame while the rollers are maintained in said operative position, the axis of the roller supported by said movably mounted frame means remaining during its movement generally within a plane perpendicular to a tangent through said bite, whereby the separation between said roller axes while the rollers are in said operative position can vary nonuniformly along the length of said bite in response to instantaneous variations in the thickness of the toner image across the support.

2. Apparatus according to claim 1, including means for moving at least one of said fuser and pressure rollers to and from an operative position and an inoperative position out of contact with the other roller.

3. Apparatus according to claim 1, wherein said mounting means permits such roller to can bodily with its axis remaining in said parallel plane.

4. Apparatus according to claim 1, wherein the pressure roller comprises a solid cylinder provided with a heat insulating surface layer.

5. Apparatus according to claim 1, and incorporating at least one cleaning roller which is rotatable in contact with the fuser roller.

6. Apparatus according to claim 1, and having a pair of sheet deflectors for intercepting and deflecting into a correct path the leading edge of any image support which clings to the fuser or pressure roller upon emergence from the bite of such rollers.

7. Apparatus according to claim 1, and including a pair of transport rollers located downstream from the fuser and pressure rollers, for transporting image-bearing supports out of the apparatus.

8. Apparatus according to claim 7, wherein said transport rollers are associated with driving means for rotating them at a peripheral speed exceeding that of the fuser and pressure rollers.

9. Apparatus according to claim 7, and incorporating a common mechanism for transmitting drive to said transport rollers and the fuser roller, said common mechanism comprising a power transmitting shaft having drive coupling elements operatively connected to said fuser roller and one of said transport rollers and a drive coupling element connectable with the motor of a xerographic copying machine.

10. Apparatus according to claim 9, wherein said power transmitting shaft carries a pinion which meshes with a pinion which is external to the said unit and is driven by a motor of the xerographic machine, and wherein each of said meshing pinions is associated with a concentric abutment surface and the two abutment surfaces make contact and determine the spacing of the axes of the meshing pinions.

11. A contact fusing apparatus according to claim 1 in which the opposite sides of said movably mounted frame are connected into an integral assembly and said assembly is supported for bodily movement away from and towards the other frame and for pivotal movement about an axis which extends perpendicular to the corresponding roller axis intermediate the ends thereof.

* * * * *